United States Patent [19]

Cobb, III

[11] Patent Number: 4,554,947

[45] Date of Patent: Nov. 26, 1985

[54] LOAD RECALL VALVE

[75] Inventor: Jasper E. Cobb, III, Gainesville, Tex.

[73] Assignee: Armco Research and Technology, Middletown, Ohio

[21] Appl. No.: 666,186

[22] Filed: Oct. 29, 1984

[51] Int. Cl.[4] ..... F15B 13/042

[52] U.S. Cl. ..... 137/596.18; 137/625.66; 251/63.4

[58] Field of Search ..... 60/442; 137/596.18, 137/625.66; 251/63.4

[56] References Cited

U.S. PATENT DOCUMENTS 3,716,074 2/1973 Peters ..... 137/596.18 X

*Primary Examiner*—Gerald A. Michalsky

*Attorney, Agent, or Firm*—Shlesinger, Arkwright, Garvey & Fado

[57] ABSTRACT

A load recall valve has a mechanical memory which coordinates the releasing of the brake with the system pressure. The mechanical memory requires that the system pressure be at least equal to the system pressure just prior to when the brake was set. Setting of the brake prior to the load being taken off the system causes the memory to be activated. Setting of the brake after the load is taken off the system causes the stored memory portion to be erased.

35 Claims, 7 Drawing Figures

LOAD RECALL VALVE

BACKGROUND OF THE INVENTION

Closed-loop hydraulic systems have been adapted for applications subject to variable loads and start/stop conditions. Closed-loop systems are very efficient and can be readily adapted so as to be, at least partially, regenerative. Smooth operation is, however, virtually impossible unless the closed-loop system is provided with a control system adapted for matching the system pressure to the load requirement. Prior art control systems have usually been electrical or electronic. Electrical and electronic control systems are, however, dependent on an electrical power supply. Additionally, the electrical and electronic systems are susceptible to damage caused by the adverse environmental conditions to which the systems are subjected. Furthermore, application of a control system on an international scale is complicated by the need to comply with the safety requirements of various countries.

Open-loop hydraulic systems have generally been preferred over closed-loop systems for applications with variable loads and stop/start conditions. An open-loop system is, generally, designed with fixed displacement pumps, fixed displacement motors or cylinders, directional control valves and counter-balance valves. Open-loop systems are not as efficient as closed-loop systems and they are usually not regenerative. Open-loop systems generally require power input to the pump in order to drive the motor with or without a load on the system and regardless of the direction of movement of the load. These open-loop systems, therefore, require larger power sources and utilize much fuel or energy due to the necessity to continuously power the pump. Large heat exchangers are also required in order to remove excessive heat from the hydraulic fluid.

A load recall valve monitors the pressure in a closed-loop hydraulic system and permits the coordination and/or control of secondary functions relative to the load on the hydraulic system. Many types of machinery; particularly, personnel handling equipment, jacking systems, heavy construction equipment, agricultural and food harvesting equipment, among others, utilize a hydrostatic transmission. Such equipment is decelerated by hydraulic braking. A mechanical brake is utilized to prevent further motion. Utilization of a load recall valve improves the performance of the apparatus when the operation requires that the motion be continued or reversed.

Proper operation of a closed-loop hydraulic system requires that the subsequent brake release occur only when the system pressure is equal to the system pressure just prior to the previous initiation of the brake setting process. Release of the brake when the system pressure equals the system pressure at the time of the previous setting of the brake assures that sufficient force is available to take-up the load without allowing the load to fall. Should the system pressure be lower than that just prior to setting of the brake, then the load will be subject to a jerking motion, or possibly, even to total free fall. Such a jerking motion or free fall is undesirable.

The prior art electrical and electronic systems utilize an electrically operated memory to store the system pressure just prior to the setting of the brake. Utilization of a memory permits coordination between the brake system and the hydraulic system and assures that sufficient lifting force is available when the brake is released.

OBJECTS AND SUMMARY OF THE INVENTION

A primary object of the disclosed invention is to provide a load recall valve having a mechanical memory which overcomes the disadvantages of prior art electrical and electronic control devices.

An additional object of the disclosed invention is to provide a memory feature permitting the valve to operate with variable pilot pressure.

A further object of the disclosed invention is to provide a load recall valve having a mechanical memory permitting an indefinite time period to pass between system cycles while still assuring that the required pressure is available prior to activation of the secondary functions.

A further object of the disclosed invention is to provide a load recall valve permitting an infinite number of secondary functions to be controlled through the valve.

A further object of the disclosed invention is to provide a load recall valve operable with any hydraulic fluid, including air and other liquid and non-liquid conventional fluids.

Yet an additional object of the disclosed invention is to provide a load recall valve which is adapted for utilization in open-looop and closed-loop hydraulic systems.

Yet still a further object of the disclosed invention is to provide a load recall valve having a manual control permitting the mechanical memory to be cleared.

Yet a further object of the disclosed invention is to provide a load recall valve utilizing a resilient seal which acts as a friction source and provides the mechanical memory.

These and other objects and advantages of the invention will be readily apparent in view of the following description and drawings of the above-described invention.

DESCRIPTION OF THE DRAWINGS

The above-identified objects and advantages and novel features of the present invention will become apparent from the following detailed description of the preferred embodiment of the invention illustrated in the accompanying drawings, wherein.

DETAILED DESCRIPTION OF THE INVENTION

Figure 1:
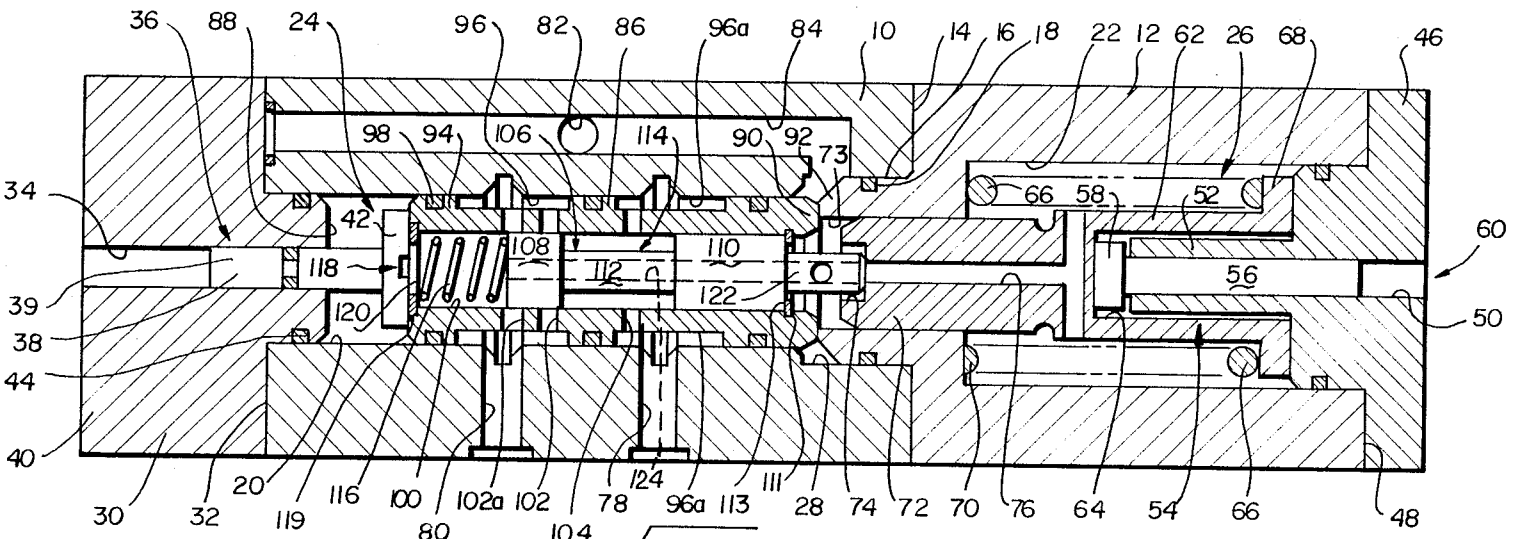
FIG. 1 is a cross-sectional view of the load recall valve of the invention with no pressure on the hydraulic system.

As best shown in FIGS. 1–6, a load recall valve, hereinafter LRV, includes a valve body 10 and a spring retainer body 12. Body 10 and body 12 are generally hollow rectangular or cylindrically members which are joined at joint 14 by fasteners (not shown) or other means. Furthermore, body 12 may be secured to body 10 at joint 16 by means of threads interdigitated with corresponding threads in the body 10. Preferably, a resilient seal 18, such as an O-ring, is provided at joint 16 to prevent leakge of fluid from body 10 and body 12 through joint 14.

It can be noted in FIGS. 1–6 that body 10 has a central generally cylindrical longitudinal aperture 20 and that body 12 has a corresponding coaxial aperture 22. Aperture 20 defines a first chamber 24 while aperture 22 defines a second chamber 26, for reasons to be explained herein later. Body 10 includes an aperture 28 coaxial with apertures 20 and 22 and which connects chamber 24 with chamber 26. It can be noted in FIG. 1 that aperture 20 has a diameter less than that of aperture 28. Aperture 28 has a diameter less than that of aperture 22 but sized to receive the forward end of body 12.

As best shown in FIG. 1, low pressure closure cap 30 is secured to end 32 of body 10. Closure cap 30 includes a central longitudinal aperture 34 which is, preferably, coaxial with apertures 20, 22 and 28. Preferably, aperture 34 includes means, such as threads or a connector, for connecting aperture 34 to a source of fluid pressure. Piston 36 having a shaft 38 is slidably disposed in aperture 34 and has a length such that the end 39 of shaft 38 does not extend beyond end 40 of closure cap 30. Head 42 of piston 36 is sized to have a diameter slightly less than the diameter of aperture 20. Preferably, O-ring 44 seals low pressure closure cap 30 to aperture 20 of body 10.

As best shown in FIG. 1, high pressure closure cap 46 is secured to end 48 of body 12. Cap 46 includes a central longitudinal aperture 50 which is, preferably, coaxial with the apertures 20, 22 and 28. Aperture 50 includes means, such as threads or a connector, at the end thereof for connecting high pressure closure cap 46 a source of system pressure.

High pressure closure cap 46 has an extension 52 with a diameter less than the diameter of aperture 22 and extending longitudinally a substantial distance into chamber or cavity 26. Piston 54 has a shaft 56 slidably disposed in aperture 50. Piston 54 has a head 58 with a diameter substantially corresponding to the outer diameter of extension 52. Displacement of piston 54 in aperture 50 is facilitated by extension 52 which guides shaft 56 during longitudinal displacement of piston 54 brought about by pressure changes on the system inlet 60.

Plunger 62 is longitudinally displaceably mounted in chamber 26 and has a central longitudinal substantially cylindrical recess 64 adapted for receiving therein extension 52 and head 58 of piston 54. Coil spring 66 is disposed about plunger 62 and has a portion thereof engagable with radially extending flange 68 of plunger 62. The other end of coil spring 66 bears against the end wall 70 of chamber 26. Coil spring 66, therefore, urges the plunger 62 longitudinally rearwardly toward closure cap 46 so that the end face of flange 68 engages closure cap 46.

Plunger 62 has a longitudinally extending coaxial extension 72 which is disposed within and adapted for being displaced through aperture 28 of body 10. Body 12 has an aperture 73 wherein extension 72 is slidably received. Extension 72 includes a forward coaxial substantially cylindrical recess 74, for reasons to be explained herein later. Additionally, extension 72 includes a T-shaped aperture 76 which permits communication of chamber 24 with chamber 26.

As best shown in FIG. 1, transverse aperture 78 communicates with chamber 24 and provides a pilot pressure input having means for connection to a pilot pressure source. Parallal aperture 80 similarly communicates with chamber 24 and is connected to a secondary operator (not shown) and cooperates with input 78 for controlling operation of the operator (not shown). A third aperture 82 extends through body 10 and communicates with chamber 24 for draining hydraulic fluid therefrom as the fluid is collected in duct 84.

Longitudinally extending hollow generally cylindrical sleeve 86 is slidably mounted in chamber 24 and is adapted for being displaced between aperture 28 and generally rear wall 88 of low pressure closure cap 30. It can be noted in FIG. 1 that sleeve 86 has a forward portion 90 which is engagable with extension 92 of body 12. Sleeve 86 has a plurality of sets of radially outwardly extending flanges 94. The flange sets 94 have a uniform diameter which is in excess of the external diameter of sleeve 86. The flange sets 94 cooperate to define flow channels 96 and **96*a*. Resilient O-rings, or similar sealing means 98 are positioned between the flanges of each flange set 94 and thereby flow channel 96*a* is isolated from flow channel 96. It can be noted that each of the flange sets 94 includes a pair of closely spaced flanges with the O-ring 98** disposed therebetween.

Sleeve 86 has a central longitudinally extending aperture 100 which is, preferably, coaxial with apertures 20, 22 and 28. Apertures or orifices 102 and **102*a* radially extend through sleeve 86 and thereby connect channel 96 to central aperture 100. Similarly, aperture or orifice 104 radially extends through sleeve 86 and in this way connects flow channel 96*a* to central aperture 100. In this way, input 78 may be connected with outlet 80 whereby hydraulic fluid flowing throgh aperture 78 flows through aperture 100 and thereby to outlet 80 so as to operate the secondary operator (not shown). It can be seen that inlet 78 communicates with annular channel 96*a* while outlet 80 communicates with annular channel 96**.

Spool piece 106 has a first flange 108 and a second flange 110 interconnected by a shaft 112. Shaft 112 has a diameter less than the diameter of flanges 108 and 110 and thereby provides an annular flow channel 114 between flanges 108 and 110. Longitudinal shifting of spool piece 106 in aperture 100 causes the flow channel 114 to shift and to thereby be aligned with the apertures 102, **102*a* and 104. Shifting of spool piece 106 thereby connects the inlet 78 to outlet 80. Preferably, groove 111 is disposed in aperture 100 and receives snap ring 113. Snap ring 113 limits the stroke of spool piece 106**.

Coil spring 116 is disposed in aperture 100 adjacent spool piece 106. Snap ring 120 is disposed in groove 119 in rear end 118 of sleeve 86 and positively positions spring 116 and thereby maintains engagement of spring 116 with spool piece 106. Spring 116 bears against the rear end of flange 108 and thereby longitudinally urges the spool piece 106 toward high pressure closure cap 46.

It can be noted that flange 110 has a longitudinal coaxial extension 122 sized to be received in cylindrical recess 74 of extension 72. Spool piece 106 also has a central longitudinally extending aperture 124 which is adapted to be connected to aperture 76 of plunger 62. This permits chamber 24 to communicate with chamber 26 in order to prevent the accumulation of excessive back pressure which could cause deterioration in the operating efficiency of the load recall valve LRV.

OPERATION

As best shown in FIG. 1, load recall valve LRV is configured so that pressurized fluid input to pilot pressure input 78 is prevented from exiting output 80 by the positioning of flange 108 in blocking relationship with apertures 102 and 102*a*. Pressure from the secondary operator, which includes a brake, is input through aperture 34 and the output pilot pressure is output through aperture 80. The outlet pilot pressure is utilized to operate the secondary operation; that is, to cause the brake (not shown) to release. Consequently, the pilot pressure utilized to release the secondary operator; that is, the brake, is input through aperture 78 but the flange 108 prevents the pilot pressure from being communicated to the secondary operator; that is, to the brake release mechanism (not shown), and the secondary operator or brake (not shown) is therefore maintained set. In this mode of operation the system pressure is negligible and the piston 54 is therefore not longitudinally displaced in its aperture 50.

Figure 2:
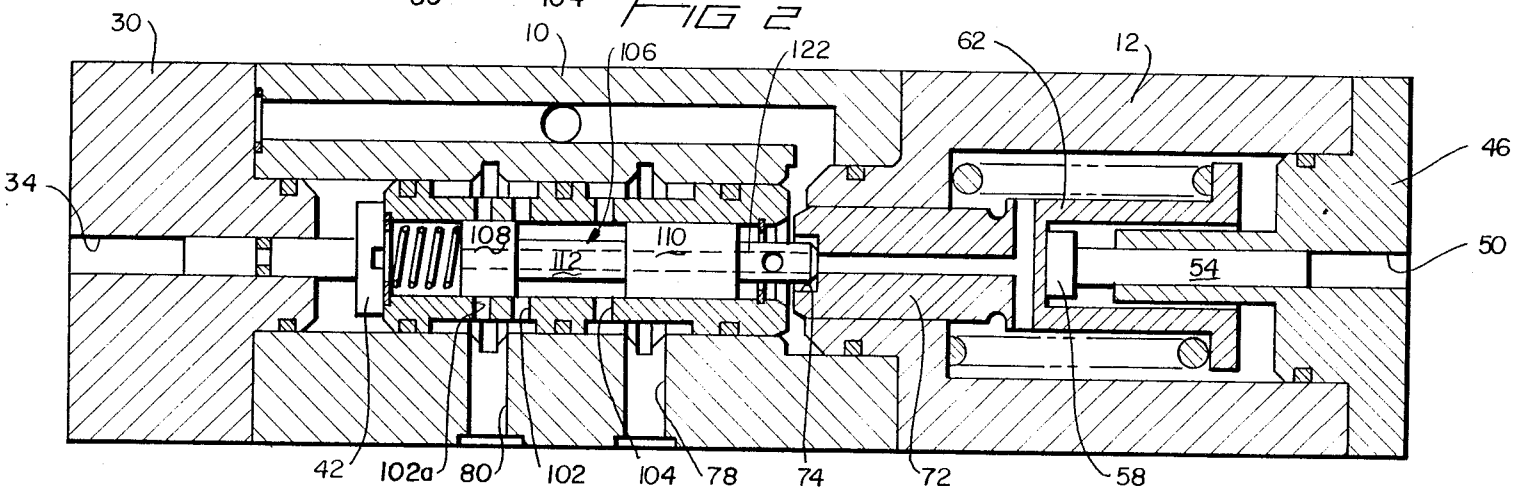
FIG. 2 is a view similar to that of FIG. 1 wherein the hydraulic system is operating but there is no appreciable load on the system.
Figure 7:
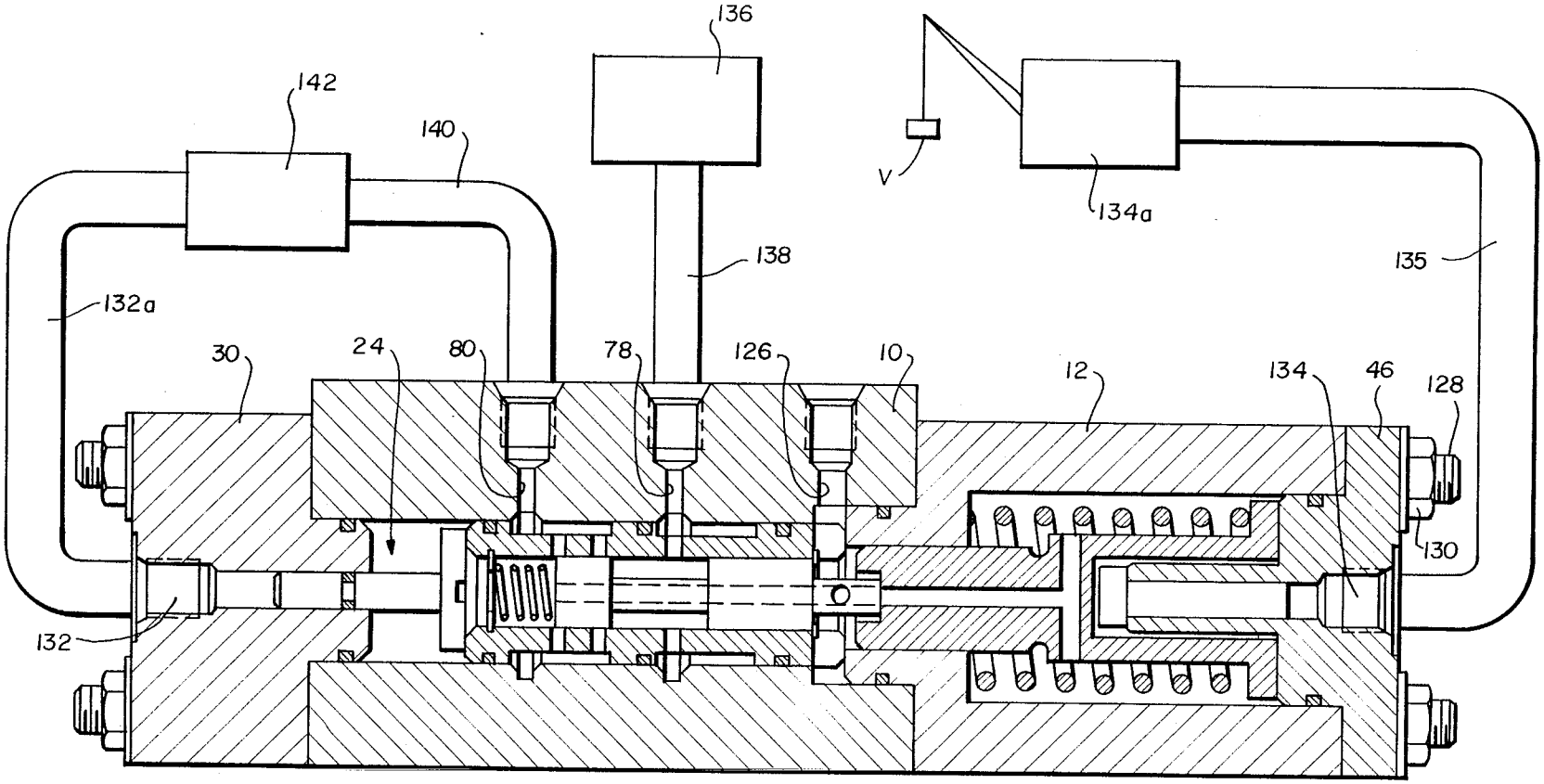

The mode of operation of FIG. 2 is that which the LRV assumes when the hydraulic system is operating and lifting the load V of FIG. 7, but wherein the load V (FIG. 7) is not appreciable. Consequently, the hydraulic system pressure input at 60 is very low. It can be noted in FIG. 2, however, that the piston 54 has been longitudinally displaced away from the high pressure closure cap 46. Displacement of piston 54 causes associated longitudinal displacement of plunger 62 and extension 72. One skilled in the art can appreciate that the displacement of plunger 62, and hence of spool piece 106, is propertional to the system pressure input at 60. Extension 122, which is receivable in recess 74, engages extension 72 and thereby causes cooperative associated longitudinal displacement of the spool piece 106. It can be noted in FIG. 2 that the flange 108 has been longitudinally shifted to the extent that the aperture 102, which was previously blocked, see FIG. 1, by the flange 108, has now been opened. Consequently, a flow channel for the pilot pressure hydraulic fluid entering input 78 is available. The fluid flows from input 78 to channel 96*a* and then through aperture 104 to flow channel 114 and then into aperture 102 and ultimately to output 80. Delivery of the pressurized fluid to output 80 causes the secondary operator or brake to be released with the result that the system is now free to raise the load V. It can be noted in FIG. 2 that the piston assembly 36 has been longitudinally shifted due to the longitudinal displacement of sleeve 86 and the spring 116 has been compressed. Similarly, the spring 66 has been compressed.

Figure 3:
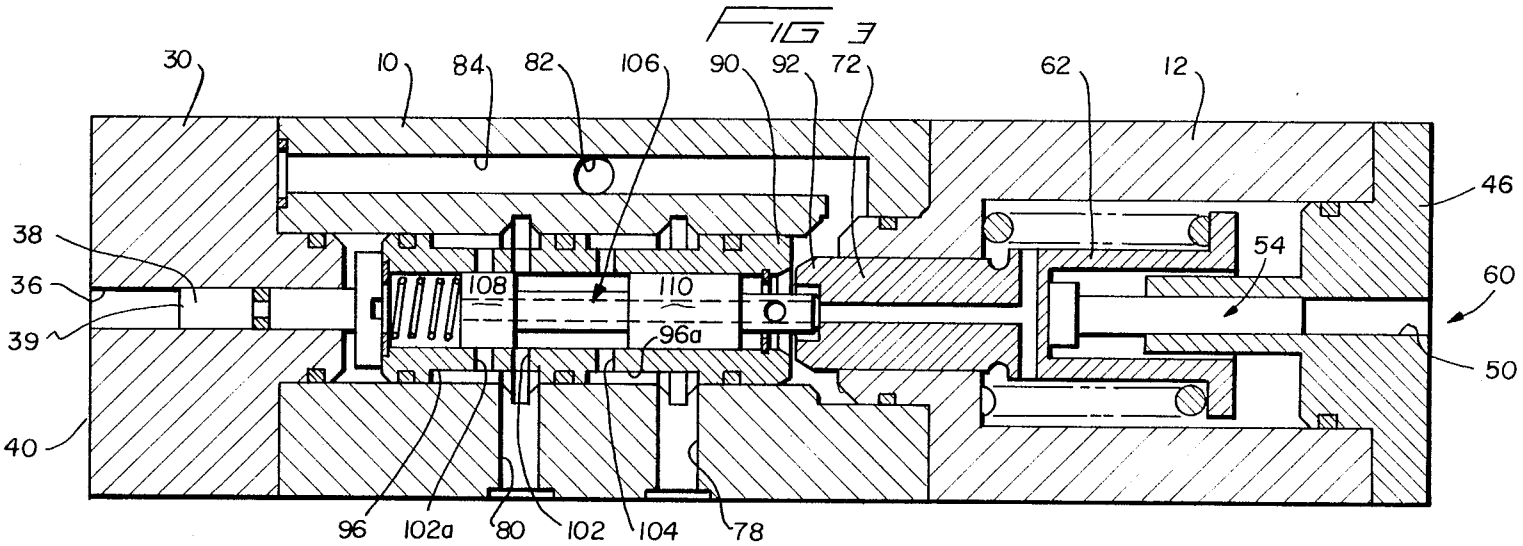
FIG. 3 is a view similar to that of FIG. 1 wherein the hydraulic system is operating with significant system pressure.

The operating mode of FIG. 3 is one wherein the hydraulic system is hoisting a significant load V with the result that the system pressure input at 60 is very high. The piston assembly 54 has been longitudinally displaced a significant distance with the result that the spool piece 106 has also been displaced a corresponding amount and thereby causes the brake to be released.

It should be noted in FIG. 3, however, that the extension 72 has been longitudinally displaced to such an extent as to also cause the sleeve 86 to be longitudinally displaced. It can be noted in FIG. 2 that the sleeve 86 was only slightly displaced due to the relatively high friction characteristics of the O-rings 98. The O-rings 98 have sufficient sliding friction to permit the spool piece 106 to be longitudinally shifted in the aperture 100 to a considerable extent while still maintaining the sleeve 86 in its position. Engagement of front portion 90 with extension 92 causes sleeve 86 to be displaced. Otherwise, O-rings 98 hold sleeve 86 in position while permitting the spool piece 106 to freely slide in aperture 100. O-rings 98, therefore, have a relatively high coefficient of sliding friction.

As best shown in FIG. 3, piston assembly 36 has been longitudinally shifted and it can be seen that the end 39 of shaft 38 does not extend beyond the rear wall 40 of low pressure closure cap 30. It can also be noted in FIG. 3 that longitudinal shifting of sleeve 86 permits any hydraulic fluid which may have leaked past the seals 98 to be collected in duct 84 and ultimately drained through aperture 82.

Figure 4:
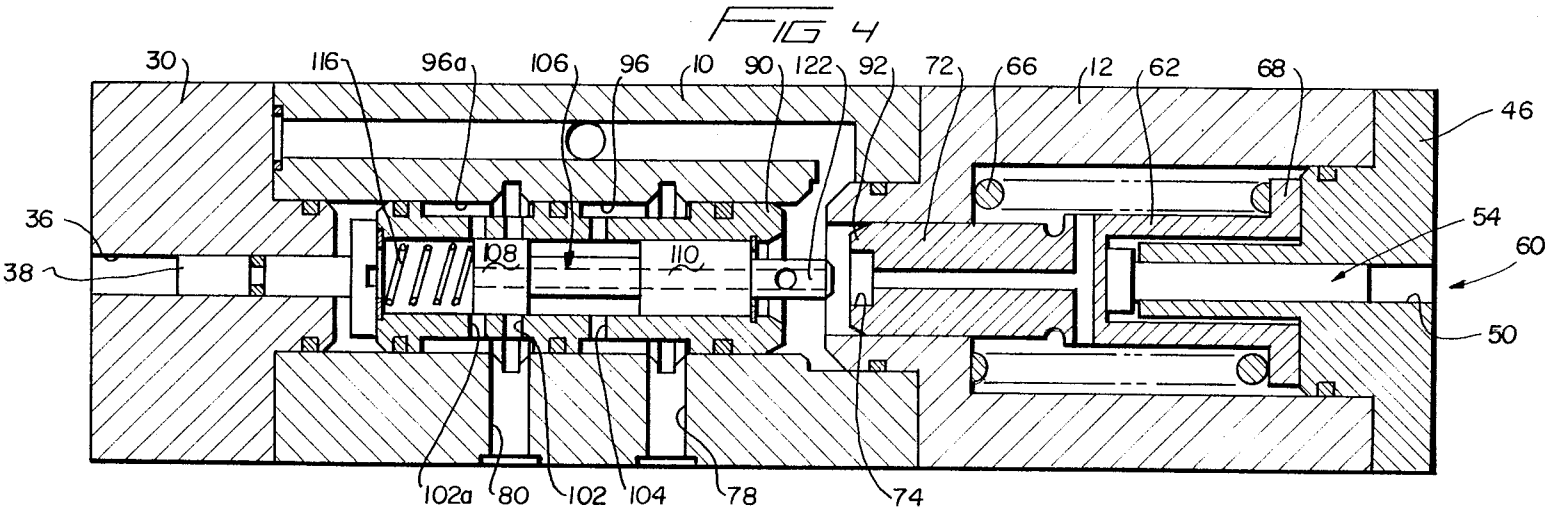
FIG. 4 is a view similar to that of FIG. 3 wherein the hoist brake has been applied prior to the 'load being removed from the hydraulic system.

The operating mode of FIG. 4 is one wherein the hoist or mechanical brake has been applied prior to the load V being removed from the hydraulic system. Consequently, the load V has been transferred from being supported by the hydraulic system to being supported by the brake. The brake, consequently, engages while the hydraulic motor is essentially stopped. The pressure required to release the brake (pressure at aperture 36) decays prior to the pressure at aperture 60 decaying.

The braking system or the secondary operator is one wherein the brake pressure is applied to release the brake. The result is that the brake is set when the brake system pressure is decreased. Consequently, it is necessary that the pilot pressure available to aperture 80 be blocked by the flange 108 in order to prevent the brake from being released.

As best shown in FIG. 4, the brake has been set with the result that the spring 116 longitudinally displaces the spool piece 106 toward the high pressure closure cap 46 and thereby blocks port 102. Simultaneously pressure at aperture 80 is drained through port 102*a* ultimately to aperture 82. The seal rings 98, however, prevent the sleeve 86 from being laterally displaced with the result that the sleeve 86 maintains the position achieved just prior to the brake being set. The spring 116, however, displaces the spool piece 106 to the extent that the flange 108 blocks the aperture 102 and thereby prevents the pilot hydraulic fluid from communicating with the brake release output 80. The spring 66 bears against the flange 68 and thereby causes the plunger 62 to be longitudinally displaced until it is again in contact with high pressure closure cap 46. Consequently, as best shown in FIG. 4, the extension 122 is now spaced from its receiving recess 74 and front portion 90 is spaced from extension 92.

Figure 5:
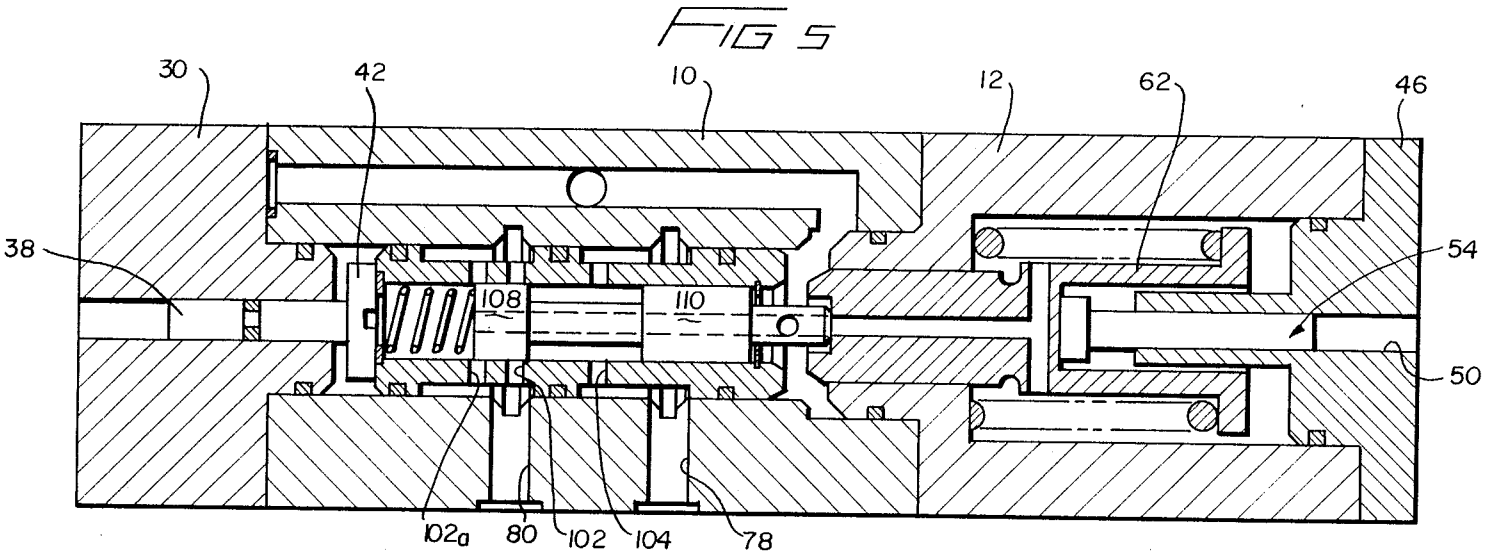
FIG. 5 is a view similar to that of FIG. 4 wherein the load is held by the brake and the hydraulic system pressure is increasing.

The positions of the sleeve 86 and the spool piece 106 in FIG. 5 disclose the mechanical memory feature of the LRV. As has been previously explained, the brake (not shown) is not released until such time as the flange 108 uncovers the aperture 102 and thereby permits the pilot fluid to be communicated from the input 78 to the output 80. The spool piece 106 cannot be shifted, however, except by longitudinal displacement of the plunger 62.

The spring 116 has insufficient force to cause the spool piece 106 to be longitudinally displaced to the extent that the input 78 will be capable of communicating with the output 80 and spool piece 106 is ultimately blocked by retaining ring 113. Consequently, it is only by displacement of the plunger 62 to the position achieved just prior to the setting of the brake that will again permit the brake (not shown) to be released. Therefore, the system pressure input to the aperture 50 must be at least equal to the system pressure just prior to the time that the brake (not shown) was set. Otherwise, the spool piece 106 will not be shifted the distance required to unblock the aperture 102. It can be seen, therefore, that the system pressure input at 60 must build up to the level achieved just prior to the brake (not shown) being set. Only this system pressure will permit the spool piece 106 to be shifted so that the flange 108 will unblock the aperture 102 and thereby permit the input 78 to communicate by means of annular flow channel 114 with the output 80. The shifting of the sleeve 86 by longitudinal displacement of the plunger 62 permits the mechanical memory to be activated.

Setting of the brake, prior to removal of the load from the system, causes the pressure input at 34 to be significantly reduced. Therefore, piston 36 remains displaced and does not urge sleeve 86 toward closure cap 46. Spool piece 106 is shifted by spring 116, however, and thereby blocks port 102. Shifting of spool piece 106 does not, however, shift sleeve 86 due to the friction characteristics of O-rings 98. The sleeve 86, due to the displacement of the piston assembly 36, remembers what the system pressure at 60 was just prior to the brake being set. Because the sleeve 86 is not displaced when the brake is set prior to the load being taken off the system, the same system pressure input at 60 must be achieved again prior before the brake (not shown) can be released. Consequently, the resilient frictional seals 98 serve the important function of maintaining the sleeve 86 in its position while permitting the spool piece 106 to be longitudinally shifted both by cooperation of extension 122 with extension 72 and by displacement of spring 116.

The operating mode of FIG. 5 is one wherein the load V is being held by the brake and the hydraulic system is building up pressure which is input at 60. As was previously described, the system pressure must build up to the level attained just prior to the brake being set before the brake will release. It can be seen in FIG. 5, by reference to the displacement of plunger 62 and the position of sleeve 86, that the system pressure has not quite attained the level which had been achieved prior to the brake being set. Consequently, the spool piece 106 has not been longitudinally displaced sufficiently far enough by the plunger 62. The flange 108 continues to block the aperture 102 and thereby prevents the pilot pressure input 78 from communicating with the output 80. The brake will not release until the spool piece 106 has been shifted the distance shifted prior to the brake being set. Consequently, the load continues to be held by the brake.

Figure 6:
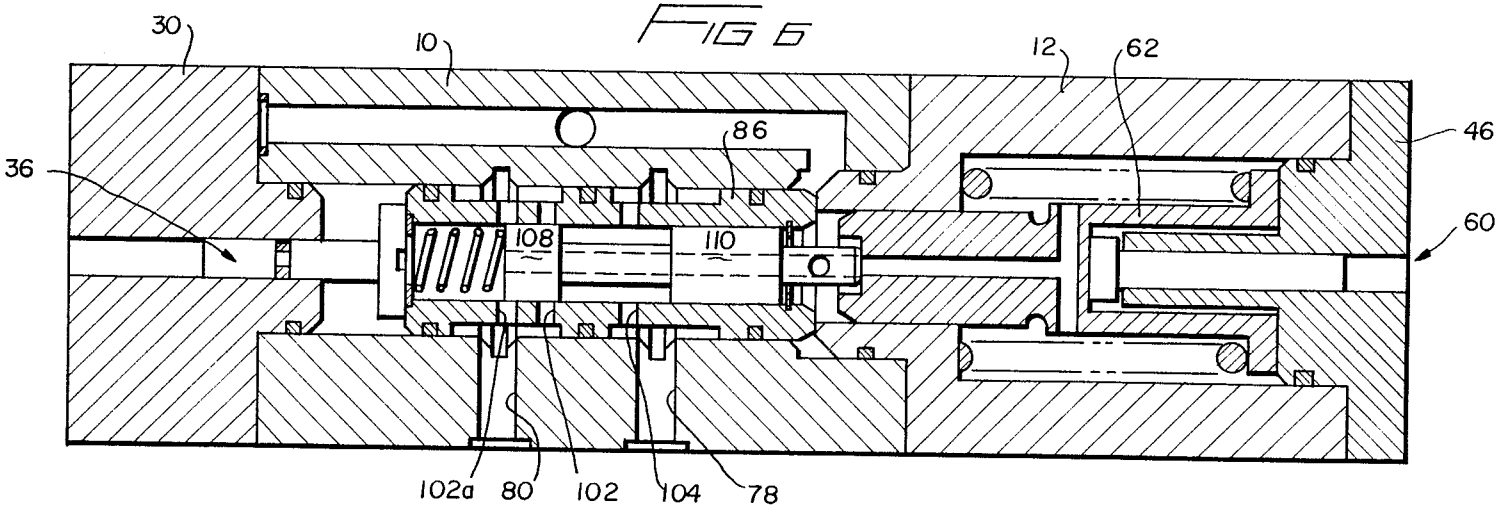
FIG. 6 is a view similar to that of FIG. 4 wherein the hoist brake has been applied after the load has been removed from the hydraulic system; and, FIG. 7 is a cross-sectional view of another embodiment of the load recall valve of FIG. 1 and disclosing portions of a hydraulic system of a crane connected to the valve.

The operating mode of FIG. 6 is one wherein the brake has been applied after the load has been removed from the hydraulic system. Consequently, the brake engages with the motor essentially stopped and when the system pressure input at 60 is at a low level.

Reduction of the system pressure to a low, or almost negligible, level causes the spring 66 to bear against the flange 68 and to thereby longitudinally displace the plunger 62 until such time as the plunger 62 again meets the high pressure cap 46. Because the brake has not been applied until after the load has been removed, the piston assembly 36 is displaced toward the high pressure cap. The brake is released through application of pressure which is input at 34 and thereby causes shifting of piston 36. Piston 36 thereby displaces sleeve 86. Consequently, the sleeve 86 and the spool piece 106 are longitudinally displaced until they are again at their extreme position relative to the closure cap 46. The brake cylinder pressure continues to be maintained with the result that the piston assembly 36 is shifted to the right and thereby causes associated displacement of the sleeve 86 and the spool piece 106. This displacement has the effect of erasing the memory by longitudinally displacing sleeve 86 until the front portion 90 thereof engages extension 72 of the body 12. Consequently, the LRV does not remember what the system pressure input at 60 was when the brake was applied.

Shifting of the spool piece 106 causes the flange 108 to again block the port 102 and thereby prevents the brake from releasing. Simultaneously, pressure at aperture 80 is released, permitting the brake (not shown) to set. Setting of the brake subsequently does not cause the piston assembly 36 to shift because the pressure is reduced not increased. Consequently, no displacement force is exerted on piston 36. The pressure is applied when the brake is released with the result that the piston 36 is shifted towards the flange 108 when the pressure is applied. The piston 36 may only be shifted toward the low pressure closure cap 30 when the brake has been released and the plunger 62 has been displaced away from cap 46.

The embodiment of FIG. 7 is similar to that of FIGS. 1–6 with the exception that drain port 126 is in direct fluid communication with the second chamber 24. The drain port 126 is longitudinally aligned in parallel relationship with the ports 78 and 80. Furthermore, a plurality of rods 128 are disposed about the body 10 and extend by means of apertured housings, between the low pressure closure cap 30 and the high pressure closure cap 46. A plurality of nuts 130 are mounted to the rods 128 and thereby maintain the LRV in a fluid tight relationship. This configuration avoids the necessity of welding the body 12 to the body 10.

The embodiment of FIG. 7 also discloses a connection means 132 disposed in low pressure low cap 30 permitting the LRV to be connected to the brake cylinder pressure supply line **132*a*. A similar connection means 134 is disposed in the high pressure closure cap 46 aperture 50 permitting the aperture 50 to be connected with the system supply pressure mechanism 134*a* through line 135. Similar connection means 132 are disposed in each of the apertures 78, 80 and 126. It should be noted that pilot supply 136 is connected by line 138 to input 78. Similarly, output 80 is connected by line 140 to brake mechanism 142 which is also connected to line 132*a***.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What I claim is:

1. A load recall valve, comprising:

(a) a hollow valve body having a first pressure inlet, a second pressure inlet, a pilot pressure inlet and a pilot pressure outlet;

(b) said pilot pressure inlet is proximate said pilot pressure outlet;

(c) sleeve means slidably disposed in said body and including means for selectively isolating said pilot pressure inlet from said pilot pressure outlet and further including a longitudinally extending aperture therethrough communicating with a plurality of generally transverse orifices for connecting said aperture to said pilot pressure inlet;

(d) spool means slidably disposed in said aperture and including means for interconnecting said orifices for thereby permitting selective interconnection of said pilot pressure inlet with said pilot pressure outlet;

(e) first pressure receiving means slidably disposed within said body communicating with said first pressure inlet and engagable with said spool means and said sleeve means whereby application of pressure to said first pressure receiving means causes sliding thereof in a first direction and associated sliding of said spool means and subsequently causes sliding of said sleeve means for thereby establishing interconnection between said pilot outlet and said pilot inlet;

(f) resilient means associated with said first pressure receiving means for causing sliding of said first pressure receiving means in a second direction opposite to said first direction upon cessation of application of pressure thereto;

(g) second pressure receiving means slidably disposed within said body and communicating with said second inlet and adapted for sliding in said first direction upon engagement with said sleeve means and for being displaced in said second direction by application of pressure to said second pressure inlet; and (h) biasing means associated with said second pressure receiving means and said spool means for displacing said spool means in said second direction whereby application of pressure to said first pressure receiving means causes at least said spool means to slide in said first direction to a position associated with the amount of pressure applied for thereby interconnecting said pilot pressure inlet with said pilot pressure outlet and whereby cessation of application of pressure to said second pressure receiving means prior to cessation of application of pressure to said first pressure receiving means causes said sleeve means to remain in said position while said biasing means causes said spool means to slide a distance sufficient to isolate said pilot inlet from said pilot outlet and thereby provide a stored memory position and further whereby cessation of pressure application to said second pressure means after cessation of pressure application to said first pressure receiving means causes said sleeve means to slide in said second direction and thereby erase said stored memory position.

2. The valve as defined in claim 1, wherein:

(a) said first pressure inlet is longitudinally aligned with said second pressure inlet; and, (b) said pilot pressure inlet and said pilot pressure outlet are each generally transverse to said first and second pressure inlets.

3. The valve as defined in claim 1, wherein:

(a) resilient seal means associated with said sleeve means and engagable with said body for isolating said pilot pressure inlet from said pilot pressure outlet.

4. The valve as defined in claim 3, wherein:

(a) said resilient seal means have a coefficient of sliding friction sufficient to permit said spool means to slide in said aperture without causing associated sliding of said sleeve means.

5. The valve as defined in claim 3, wherein:

(a) a plurality of radially extending spaced flanges are disposed about the periphery of said sleeve means and each of said flanges includes means for seating one of said resilient seal means;

(b) a plurality of flow channels are disposed about said sleeve means and extend between said flange means; and, (c) said orifices communicate with said flow channels.

6. The valve as defined in claim 1, wherein:

(a) said spool means includes a pair of coaxial flanges interconnected by a coaxial shaft;

(b) a coaxial extension extends from one of said flanges and is adapted for engagement with said first pressure receiving means; and, (c) said shaft has a diameter less than the diameter of said flanges for thereby providing an annular flow channel for connecting said pilot pressure inlet with said pilot pressure outlet.

7. The valve as defined in claim 1, wherein:

(a) securing means are disposed in said sleeve and spaced from said spool means for positively positioning said biasing means.

8. The valve as defined in claim 7, wherein:

(a) said biasing means includes a spring.

9. The valve as defined in claim 1, wherein:

(a) said body is closed at one end thereof by a low pressure closure cap;

(b) said second pressure inlet is disposed in said low pressure closure cap; and, (c) said second pressure receiving means has a portion thereof slidably disposed within said second pressure inlet.

10. The valve as defined in claim 9, wherein:

(a) said second pressure inlet includes an aperture of substantial length through said low pressure closure cap;

(b) said second pressure receiving means includes a piston having a shaft portion thereof slidably disposed within said low pressure closure cap aperture; and, (c) said shaft has sufficient length so as not to extend beyond said low pressure closure cap when said piston has been displaced in said first direction.

11. The valve as defined in claim 9, wherein:

(a) said body is closed at an end opposite said one end by a high pressure closure cap;

(b) said first pressure inlet is disposed in said high pressure closure cap; and, (c) said first pressure receiving means has a portion thereof slidably disposed in said first presssure inlet.

12. The valve as defined in claim 11, wherein:

(a) said first pressure receiving means includes a displaceable cylinder having an extension thereof engagable with said spool means and said sleeve means;
(b) recess disposed in said cylinder and aligned with said first pressure inlet; and,
(c) said first pressure receiving means associated with said first pressure inlet for displacing said cylinder upon application of pressure thereto.

13. The valve as defined in claim 12, wherein:
(a) said resilient means disposed about said cylinder.

14. The valve as defined in claim 13, wherein:
(a) a peripheral flange extends around said cylinder at an end thereof adjacent said high pressure closure cap; and,
(b) a spring is disposed about said cylinder and has a portion thereof engagable with said cylinder flange for displacing said cylinder in said second direction.

15. The valve as defined in claim 12, wherein:
(a) said spool means and said cylinder each includes an aligned cooperating aperture for preventing pressure build up in said body.

16. The valve as defined in claim 1, wherein:
(a) a drain port communicates with said hollow body.

17. A load recall valve, comprising:
(a) a valve body having first and second chambers therein and including means interconnecting said chambers;
(b) first and second pressure inlets disposed in said body and each of said inlets communicating with one of said chambers;
(c) a displaceable cylinder disposed in said first chamber and including an extension thereof displaceable through said means and said cylinder including a recess aligned with said first inlet;
(d) a displaceable piston disposed in said recess and engagable with said extension and cooperating with said inlet for displacing said cylinder in a first direction when pressure is applied to said first inlet;
(e) biasing means associated with said cylinder and adapted for displacing said cylinder and said piston thereby in a second direction opposite to said first direction when pressure application to said first inlet ceases;
(f) a pilot inlet and a pilot outlet are disposed in said body and communicate with said second chamber;
(g) sleeve means having a longitudinal aperture therethrough aligned with said extension and slidably disposed in said second chamber and engagable with said extension and adapted for being displaced thereby;
(h) said sleeve means includes means for selectively isolating said pilot inlet from said pilot outlet and further includes means for connecting said pilot inlet with said sleeve aperture;
(i) spool means slidably disposed within said sleeve aperture and engagable with said extension and adapted for being displaced thereby and including means cooperating with said means for connecting for thereby connecting said pilot inlet with said pilot outlet upon displacement thereof;
(j) piston means slidably associated with said second inlet and engagable with said sleeve means and adapted for shifting said sleeve means in a second direction upon application of pressure to said second inlet; and,
(k) biasing means associated with said second inlet piston and with said spool means for sliding said spool means in said second direction upon cessation of pressure application to said first inlet whereby at least said spool means is displaced to a position associated with the amount of pressure applied and whereby cessation of pressure application to said second inlet prior to cessation of pressure application to said first inlet causes said sleeve means to be maintained in said position while said biasing means displaces said spool means a distance sufficient to isolate said pilot inlet from said pilot outlet for thereby providing a stored memory position and further whereby cessation of pressure application to said second inlet subsequent to the cessation of pressure application to said first inlet causes said spool means and said sleeve to be displaced in said second direction and thereby erases said stored memory position.

18. The valve as defined in claim 17, wherein:
(a) said chambers, said means and said first and second pressure inlets are coaxially aligned.

19. The valve as defined in claim 18, wherein:
(a) said pilot inlet and said pilot outlet are disposed generally transverse to said second chamber.

20. The valve as defined in claim 17, wherein:
(a) said first chamber is closed by a high pressure closure cap;
(b) an aperture disposed in said high pressure closure cap coaxially with said first pressure inlet; and,
(c) said piston has a portion thereof slidably disposed within said high pressure closure cap aperture and adapted for being guided therein during displacement thereof.

21. The valve as defined in claim 20, wherein:
(a) said cylindrical recess being cylindrical disposed in said cylinder coaxial with said first pressure inlet; and,
(b) said high pressure closure cap includes an extension thereof received in said recess for guiding said cylinder during displacement thereof.

22. The valve as defined in claim 21, wherein:
(a) a peripheral flange extends around said cylinder adjacent said high pressure closure cap; and,
(b) said biasing means disposed around said cylinder and a portion thereof engagable with said flange for displacing said cylinder in said second direction.

23. The valve as defined in claim 17, wherein:
(a) a plurality of longitudinally spaced resilient seal means disposed about the periphery of said sleeve means and engagable with said body for permitting displacement of said spool means without associated displacement of said sleeve means.

24. The valve as defined in claim 23, wherein:
(a) a plurality of longitudinally spaced radially extending flanges extend around said sleeve means for isolating said pilot inlet from said pilot outlet; and,
(b) each of said flanges includes a means for seating one of said resilient seal means.

25. The valve as defined in claim 24, wherein:
(a) a plurality of spaced annular flow channels disposed about said sleeve means and extend between said flanges and adapted for connecting said pilot inlet and said pilot outlet with said sleeve means aperture.

26. The valve as defined in claim 25, wherein:

(a) a plurality of orifices generally radially disposed in said sleeve means and at least one of said orifices is associated with each of said flow channels for permitting connection of said pilot inlet with said pilot outlet through said sleeve means aperture.

27. The valve as defined in claim 17, wherein:

(a) securing means associated with the end of said sleeve means aperture adjacent said piston means and adapted for positively positioning said biasing means.

28. The valve as defined in claim 27, wherein:

(a) said biasing means includes a spring disposed in said sleeve means aperture engagable with said securing means and said spool means.

29. The valve as defined in claim 17, wherein:

(a) said second chamber is closed at an end thereof opposite said means by a low pressure closure cap;

(b) an aperture is disposed in said low pressure closure cap coaxial with said second pressure inlet; and, (c) said piston means includes a portion thereof slidably disposed in said low pressure closure cap and adapted for being guided therein during displacement thereof.

30. The valve as defined in claim 29, wherein:

(a) said piston means includes a piston having a shaft portion thereof disposed in said low pressure closure cap aperture; and, (b) said shaft has a length insufficient to cause said shaft to extend outwardly beyond said low pressure closure cap.

31. The valve as defined in claim 17, wherein:

(a) said spool means includes at least two flanges having a diameter generally corresponding to said sleeve aperture diameter and a shaft interconnects said flanges;

(b) said shaft has a diameter less than said sleeve means aperture diameter for thereby providing an annular flow channel; and, (c) a shaft extension longitudinally extends from one of said flanges and is engagable with said cylinder.

32. The valve as defined in claim 31, wherein:

(a) a cylindrical recess disposed in said cylinder and adapted for receiving said shaft extension therein.

33. The valve as defined in claim 17, wherein:

(a) said spool means and said cylinder each includes an aligned coaxial aperture adapted for being interconnected to thereby permit venting of said chambers.

34. The valve as defined in claim 17, wherein:

(a) a drain port communicates with said second chamber.

35. The valve as defined in claim 17, wherein:

(a) said first chamber has a diameter exceeding said second chamber diameter.

* * * * *

UNITED STATES PATENT AND TRADEMARK OFFICE

CERTIFICATE OF CORRECTION

PATENT NO. : 4,554,947

DATED : November 26, 1985

INVENTOR(S) : Jasper E. Cobb, III

It is certified that error appears in the above-identified patent and that said Letters Patent is hereby corrected as shown below:

Title page:

Assignee: Armco, Inc.,
Middletown, Ohio

Signed and Sealed this

*Eighteenth* Day of *March 1986*

[SEAL]

*Attest:*

DONALD J. QUIGG

*Attesting Officer*

*Commissioner of Patents and Trademarks*